United States Patent [19]

Koshizuka et al.

[11] Patent Number: 4,840,848

[45] Date of Patent: Jun. 20, 1989

[54] THERMAL TRANSFER RECORDING MEDIUM

[75] Inventors: Kunihiro Koshizuka; Takao Abe, both of Tokyo, Japan

[73] Assignee: Konica Corporation, Tokyo, Japan

[21] Appl. No.: 146,243

[22] Filed: Jan. 20, 1988

[30] Foreign Application Priority Data

Jan. 27, 1987 [JP] Japan ..... 62-16870

[51] Int. Cl.[4] ..... B41M 5/00

[52] U.S. Cl. ..... 428/413; 428/195; 428/447; 428/484; 428/488.1; 428/913; 428/914

[58] Field of Search ..... 428/195, 447, 484, 488.1, 428/913, 914, 413

[56] References Cited

U.S. PATENT DOCUMENTS 4,684,561 8/1987 Imai et al. ..... 428/913

*Primary Examiner*—Ellis P. Robinson
*Assistant Examiner*—P. R. Schwartz
*Attorney, Agent, or Firm*—Frishauf, Holtz, Goodman & Woodward

[57] ABSTRACT

There is disclosed a thermal transfer recording medium having a thermal transfer colorant layer provided on a support, characterized in that the thermal transfer colorant layer contains a modified silicone compound and a polyoxyethylene type compound.

15 Claims, No Drawings

THERMAL TRANSFER RECORDING MEDIUM

BACKGROUND OF THE INVENTION

This invention relates to a thermal (heat-sensitive) transfer recording medium, more specifically it relates to a thermal transfer recording medium which can provide a good printing quality to a paper to be transferred and can use effectively even in a small device which is small in winding torque.

Recently, a thermal transfer recording system using a thermal transfer recording medium has been attracted attention.

The thermal transfer recording system is a method in which, on a sheet-like support, by using a thermal recording medium which is being provided thereon a thermal transfer colorant layer comprising by dispersing a colorant in a heat-fusible substance and/or thermal plastic resin, an ink image which corresponds to heated portions of a thermal head is formed on the medium to be transferred by heating the thermal transfer colorant layer from the support side of the thermal recording medium with use of the thermal head at the state of contacting with a medium to be transferred (generally, a paper) to fuse (or soften) the thermal transfer colorant layer whereby transferring the layer to the medium to be transferred.

The thermal transfer recording medium to be used in this method is generally used in the state of being contained in a cassette.

The thermal transfer recording medium having such a state is wounded in the cassette at the condition that the thermal transfer colorant layer and a back surface of the support are contacted with each other. When it has been stored at that condition for a long term, a part of the heat fusible substance, etc. of the thermal transfer colorant layer becomes a fused state, and will sometimes cause an adhesion strength between the back surface of the support and the surface of the thermal transfer colorant layer. This adhesion strength is, in usual case, not so strong so that it was not a serious problem in the large scale apparatus conventionally used.

However, in accordance with development of a small size apparatus at the latest days, it has been found that the adhesion strength thus appeared causes a large effect to the transferring property. That is, since the small size apparatus (for example, a portable word processor, etc.) is small in driving force for running of the thermal transfer recording medium, running property of the thermal transfer recording medium is sometimes lowered even due to a little adhesive strength and such a case, transferring property is remarkably lowered. Also, when the thermal transfer recording medium is to be run, if the thermal transfer colorant layer has adhesive property, it also lowers in the running property since it contacts with support pole, etc.

Thus, in order to solve such problems, there is described a thermal transfer recording medium in which a specific amount of silicone oil has been added in Japanese Provisional Patent Publication No. 139489/1986.

However, the silicone oil used in this invention has a dimethylpolysiloxane structure, and according to the present inventors' investigation, the silicone oil having such a structure is low in compatibility with a heat-fusible substance and/or a thermal plastic resin, etc. which are main components of a thermal transfer colorant layer, and therefore, it can be found that it is difficult to uniformly disperse the silicone oil in the thermal transfer colorant layer. Further, it can be found that the silicone oil having such an unmodified dimethylpolysiloxane structure is insufficient in lubricating property as a lubricating component of a thermal transfer recording medium used in a small apparatus.

Also, in Japanese Provisional Patent Publication No. 263796/1986, an invention of a thermal transfer recording medium in which a solid ink layer contains a liquid modified silicone oil.

Thus, running properties of the thermal transfer recording medium are somewhat improved by using a modified silicone oil but it could not be said that it has been not yet sufficient. Further, even if the modified silicone oil has been used, printing quality to a medium to be transferred which is low in surface smoothness, which has recently been often used in the aforesaid portable word processor, is almost the same as before.

SUMMARY OF THE INVENTION

The present invention has been accomplished to solve the above problems and an object of the present invention is to provide a thermal transfer recording medium which has good running property as well as capable of printing letters with good quality even to a medium to be transferred which is low in surface smoothness.

The present invention is to accomplish the above object and the constitution thereof is a thermal transfer recording medium having a thermal transfer colorant layer provided on a support, characterized in that said thermal transfer colorant layer contains a modified silicone compound and a polyoxyethylene type compound.

DESCRIPTION OF THE PREFERRED EMBODIMENTS

In the following, the present invention will be explained in more detail.

Support (Substrate)

The support as the substrate to be used in the thermal transfer recording medium according to the present invention should preferably have heat-resistant strength, dimentional stability and high surface smoothness.

Examples of the material for support may include various papers such as plain paper, condenser paper, laminated paper, coated paper, etc.; sheets or films of thermoplastic resins such as polyethylene, polypropylene, polyethylene terephthalate, polystyrene, polyimide, etc.; composites of the above papers with the above thermoplastic resin films or sheets; metal sheets such as metal foils of aluminum, etc. Particularly preferred material for support is polyethylene terephthalate.

The thickness of the support may be generally about 60 $\mu$m or less for obtaining good thermal conductivity, particularly preferably 1.5 to 15 $\mu$m.

The constitution of the back surface of the support may have any desired constitution. Thus, the back surface of the support may be provided a backing layer (a back coating layer) such as a stiking preventive layer, etc.

Thermal transfer colorant layer

On the about support, a thermal transfer colorant layer is provided. This thermal transfer colorant layer usually comprises dispersing a colorant in a heat-fusible substance and/or a thermoplastic resin. In the thermal transfer recording medium of the present invention, a modified silicone compound and a polyoxyethylene type compound are containined in the thermal transfer colorant layer.

(Modified silicone compound)

The modified silicone compound to be used in the thermal transfer recording medium of the present invention may be a liquid, a solid or a semisolid one at a normal temperature.

For example, when a liquid state modified silicone compound is used, it can preferably be used those having a viscosity (at 25° C.) of 20,000 cs or lower (preferably 19,000 cs or lower, particularly preferably 10,000 cs or lower, more preferably in the range between 5 and 7,500 cs). If the viscosity is higher than 20,000 cs, workability will sometimes lower and a slight adhesive force will sometimes be generated on the surface of the thermal transfer colorant layer.

Also, the modified silicone compound which is a solid or semisolid at a normal temperature act as a lubricant on the surface of the thermal transfer colorant layer as well as have a function as a heat-fusible substance in this layer (details will be mentioned in the following).

Accordingly, the content of the modified silicone compound in the thermal transfer recording medium of the present invention is preferably 0.01% by weight or more based on the total components constituting the layer. Particularly, when the solid or semisolid modified silicone compound is used, the content of which is generally set in the range of 0.1 to 50% by weight based on the total weight of the components constituting the layer. It is particularly preferred to use it in the range of 1 to 20% by weight.

Also, when a silicone compound which is liquid at a normal temperature is used, the content is preferably set in the range of 0.1 to 8% by weight (more preferably 0.1 to 5% by weight).

When the solid or semisolid modified silicone compound and the silicone compound which is liquid at a normal temperature are compared with each other, they play substantially the same effect in lubricity, but there are advantage in the solid or semisolid modified silicone compound that generation of stain at the ground is less.

As the modified silicone compound to be contained in the thermal transfer colorant layer of the thermal transfer recording medium according to the present invention, usual modified silicone compounds may be used but in consideration of compatibility and lubricity of the modified silicone compound, it is preferred to use an alkyl-modified silicone compound, a polyether-modified silicone compound, an amino-modified silicone compound, an alcohol modified silicone compound, a mercapto-modified silicone compound, a carboxyl-modified silicone compound and an epoxy-modified silicone compound. These modified silicone compounds may be used alone or in combination with each other.

In the following, specific examples of the modified silicone compound to be used in the present invention will be shown.

The alkyl-modified silicone compound to be used in the present invention is represented by the formula (I):

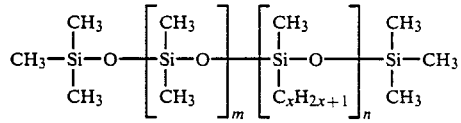

(I)

In the above formula (I), in general, m is in the range of 10 to 5,000 and n is in the range of 10 to 5,000. The alkyl group is those in which x is in the range of 1 to 5 and it may be straight or may have a branch(es). Further, for example, the alkyl group may be substituted by an aromatic group or may have a recurring unit modified with an ester of higher alcohol.

In case of the liquid state alkyl-modified silicone compound, it is preferably used those having a viscosity at 25° C. in the range between 50 and 2,000 cs.

Of these alkyl-modified silicone compound to be used in the present invention, examples which are commercially available are BX16-811(F) [viscosity (at 25° C.) 450 cs], BF-8416 [viscosity (at 25° C.) 900 cs], SH-203 [viscosity (at 25° C.) 1,200 cs], SR-230 [viscosity (at 25° C.) 1,400 cs] and SF-841C [viscosity (at 25° C.) 900 cs] all available from Toray Silicone Co., Ltd.; KF412 [viscosity (at 25° C.) 500 cs], KF413 [viscosity (at 25° C.) 100 cs] and KF414 [viscosity (at 25° C.) 100 cs] all available from Sin-etsu Kagaku Kogyo Co., Ltd.; and as an α-methylstyrene-modified silicone compound, there may include KF410 [viscosity (at 25° C.) 1,000 cs] available from the latter company and the like.

The polyether-modified silicone compound is generally represented by the formulae (II - 1) and (II - 2):

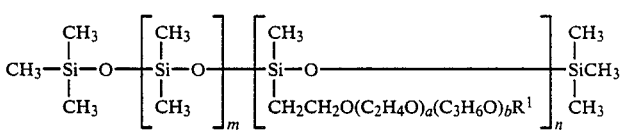

(II-1)

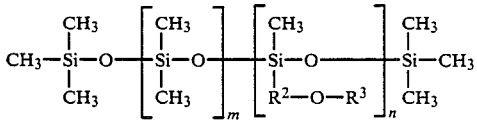

(II-2)

In the above formulae (II - 1) and (II - 2), in general, m is in the range of 10 to 5,000 n is in the range of 10 to 5,000, a is in the range of 1 to 5, b is in the range of 1 to 5, $R^1$ and $R^3$ are an alkyl group having 1 to 5 carbon atoms, and $R^2$ is an alkylene group having 1 to 5 carbon atoms. Also, in the formula (II - 2), the silicon atom may directly be bonded to the oxygen atom without via $R^2$.

In the case of using a liquid state polyether-modified silicon compound, those having a viscosity at 25° C. is in the range of 10 to 1500 cs are particularly preferably used.

Of these polyether-modified silicone compound to be used in the present invention, examples which are commercially available are SH-3746 [viscosity (at 25° C.) 120 cs], SH-3749 [viscosity (at 25° C.) 1,300 cs], SH-3771 [viscosity (at 25° C.) 320 cs], SH-8400 [viscosity (at 25° C.) 300 cs], SF-8410 [viscosity (at 25° C.) 2,900 cs], SH-8700 [viscosity (at 25° C.) 1,200 cs] and BF-8410 [viscosity (at 25° C.) 2,900 cs] all available from Toray Silicone Co., Ltd.; KF351(A) [viscosity (at 25° C.) 100 cs], KF352(A) [viscosity (at 25° C.) 1,600 cs], KF353(A) [viscosity (at 25° C.) 400 cs], KF354(A) [viscosity (at 25° C.) 130 cs], KF355(A) [viscosity (at 25° C.) 135 cs], KF615(A) [viscosity (at 25° C.) 1,250 cs], KF618 [viscosity (at 25° C.) 20 cs], KF945(A) [viscosity (at 25° C.) 220 cs], KF907(A) [solid], X-22-6008 [viscosity (at 25° C.) 1,400 cs], X-22-811 [viscosity (at 25° C.) 150 cs] and X-22-812 [viscosity (at 25° C.) 700 cs] all available from Sin-etsu Kagaku Kogyo Co., Ltd.; and the like.

The amino-modified silicone compound is generally represented by the formulae (III - 1) and (III - 2):

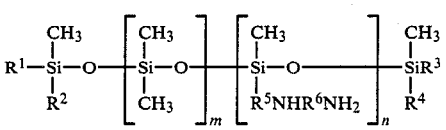

(III-1)

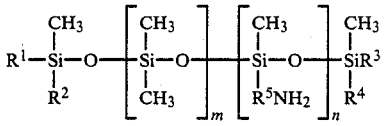

(III-2)

In the above formulae (III - 1) and (III - 2), in general, n is in the range of 10 to 5,000, m is in the range of 10 to 5,000, $R^1$ to $R^4$ are a methyl group or a methoxy group, respectively, and $R^5$ and $R^6$ are an alkylene group having 1 to 5 carbon atoms, respectively.

In the present invention, in the case of using a liquid state polyether-modified silicone compound, those having a viscosity at 25° C. is in the range of 10 to 1500 cs are particularly preferably used. The amino-modified silicone compound to be used in the present invention may further have a recurring unit modified with an alkyl group and a recurring unit modified with an aralkyl group.

Of these amino-modified silicone compound to be used in the present invention, examples which are commercially available are BX16-828IV [viscosity (at 25° C.) 2,900 cs] available from Toray Silicone Co., Ltd.; KF393 [viscosity (at 25° C.) 60 cs], KF857 [viscosity (at 25° C.) 70 cs], KF858 [viscosity (at 25° C.) 25 cs], KF859 [viscosity (at 25° C.) 60 cs], KF860 [viscosity (at 25° C.) 250 cs], KF861 [viscosity (at 25° C.) 3,500 cs], KF862 [viscosity (at 25 ° C.) 750 cs], KF864 [viscosity (at 25° C.) 1,700 cs], KF865 [viscosity (at 25° C.) 90 cs], X-22-3680 [viscosity (at 25 ° C.) 90 cs], X-22-398D [viscosity (at 25° C.) 2,300 cs], X-22-3801C [viscosity (at 25° C.) 3,500 cs] and KF 867 [viscosity (at 25° C.) 1,300 cs] all available from Sin-etsu Kagaku Kogyo Co., Ltd.; and the like.

The alcohol-modified silicone compound to be used in the present invention is represented by the formula (IV):

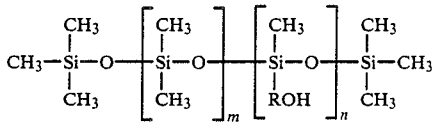

(IV)

In the above formula (IV), in general, m is in the range of 10 to 5,000, n is in the range of 10 to 5,000 and R is an alkylene group having 1 to 5 carbon atoms. In the above formula (IV) of the the alcohol-modified silicone compound, the hydroxyl group may be bonded directly to the silicon atom, and a hydroxyl group may be bonded to the silicon atom at the terminal of the silicone compound.

In the present invention, in the case of the liquid state alcohol-modified silicone compound is used, it is preferred to use those having a viscosity at 25° C. in the range between 10 and 5,000 cs.

Of these alcohol-modified silicone compound to be used in the present invention, examples which are commercially available are SF-8427 [viscosity (at 25° C.) 320 cs], SF-8428 [viscosity (at 25° C.) 170 cs], BX16-801 [viscosity (at 25° C.) 1,300 cs], BX16-817 [viscosity (at 25° C.) 4,000 cs], BX16-843A [viscosity (at 25° C.) 500 cs], BX16-843B [viscosity (at 25° C.) 700 cs] and PRX413 [viscosity (at 25° C.) 90 cs] all available from Toray Silicone Co., Ltd.; KF413 [viscosity (at 25° C.) 80 cs] and X-22-801 [solid] both available from Sin-etsu Kagaku Kogyo Co., Ltd.; and the like.

The mercapto-modified silicone compound is usually represented by the formula (V):

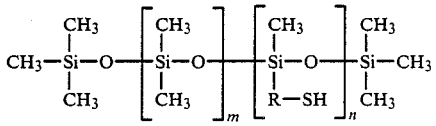

(V)

In the above formula (V), in general, m is in the range of 10 to 5,000, n is in the range of 10 to 5,000 and R is an alkylene group having 1 to 5 carbon atoms. In the above formula (V) of the the mercapto-modified silicone compound, the mercapto group may be bonded directly to the silicon atom, and a mercapto group may be bonded to the silicon atom at the terminal of the silicone compound.

In the present invention, in the case of the liquid state mercapto-modified silicone compound is used, it is preferred to use those having a viscosity at 25° C. in the range between 100 and 1,000 cs.

Of these mercapto-modified silicone compound to be used in the present invention, examples which are commercially available are BX16-838A [viscosity (at 25° C.) 290 cs] and BY16-838 [viscosity (at 25° C.) 300 cs] both available from Toray Silicone Co., Ltd.; X-22-980 [viscosity (at 25° C.) 150 cs] available from Sin-etsu Kagaku Kogyo Co., Ltd.; and the like.

The carboxyl-modified silicone compound is usually represented by the formula (VI):

(VI)

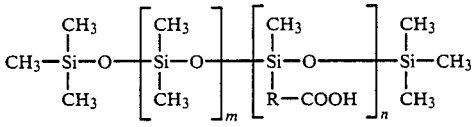

In the above formula (VI), in general, m is in the range of 10 to 5,000, n is in the range of 10 to 5,000 and R is an alkylene group having 1 to 5 carbon atoms.

In the present invention, in the case of the liquid state carboxyl-modified silicone compound is used, it is preferred to use those having a viscosity at 25° C. in the range between 40 and 5,000 cs. In the present invention, the term carboxyl-modified silicone compound is to be defined as those including a higher fatty acid-modified silicone compound.

Of these carboxyl-modified silicone compound to be used in the present invention, examples which are commercially available are SF-8418 [viscosity (at 25° C.) 2,500 cs] available from Toray Silicone Co., Ltd.; X-22-3701E [viscosity (at 25° C.) 3,000 cs], X-22-3710 [viscosity (at 25° C.) 50 cs], X-22-3715 [viscosity (at 25° C.) 200 cs], KF-910 [viscosity (at 25° C.) 35 cs], X-22-800 [solid], X-22-715 [viscosity (at 25° C.) 14,800 cs] all available from Sin-etsu Kagaku Kogyo Co., Ltd.; and the like.

The epoxy-modified silicone compound is usually represented by the formula (VII):

(VII)

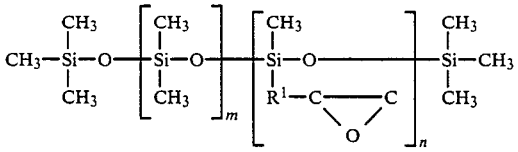

In the above formula (VII), in general, m is in the range of 10 to 5,000 and n is in the range of 10 to 5,000. Also, $R^1$ is an alkylene group having 1 to 5 carbon atoms. The epoxy-modified silicone compound to be used in the present invention may be those having a recurring unit modified with an ether group.

In the present invention, in the case of the liquid state epoxy-modified silicone compound is used, it is preferred to use those having a viscosity at 25° C. in the range between 20 and 19,000 cs.

Of these epoxy-modified silicone compound to be used in the present invention, examples which are commercially available are SF-8411 [viscosity (at 25° C.) 8,000 cs], SF-8413 [viscosity (at 25° C.) 18,000 cs], SF-8418 [viscosity (at 25° C.) 2,500 cs] and BX16-839 [viscosity (at 25° C.) 800 cs] all available from Toray Silicone Co., Ltd.; KF-100T [viscosity (at 25° C.) 19,000 cs], KF-101 [viscosity (at 25° C.) 2,000 cs], KF-102 [viscosity (at 25° C.) 7,500 cs], KF-103 [viscosity (at 25° C.) 6,000 cs] , x-60-164 [viscosity (at 25° C.) 170 cs], X-22-343 [viscosity (at 25° C.) 30 cs] and X-22-3667 [viscosity (at 25° C.) 3,000 cs] all available from Sin-etsu Kagaku Kogyo Co., Ltd.; and the like.

Of these modified silicone compound, preferred are those having an ether group or a hydroxyl group as a modified group, and among them, particularly preferred are the polyether-modified silicone compound represented by the formula (II) and the alcohol-modified silicone compound represented by the formula (IV).

(Polyoxyethylene type compound)

In the thermal transfer recording medium of the present invention, the thermal transfer colorant layer contains a polyoxyethylene type compound. The polyoxyethylene type compound to be used in the present invention is a compound having a moiety represented by the following formula in the molecule:

$$\text{-}(CH_2CH_2O)_n\text{-}$$

wherein in the above formula, n is an integer of 2 or more.

As the compound having the polyoxyethylene chain, those which are in the state of solid or semisolid state with their melting points being 30° to 120° C., particularly in the range of 40° to 100° C.

The polyoxyethylene type compounds of the present invention will be described in more detail.

The polyoxyethylene type compounds to be used in the present invention can be classified into a polyethylene glycol and a polyethylene glycol derivative.

First, the polyethylene glycol derivative will be explained.

The polyethylene glycol derivative to be used in the present invention can be prepared by, for example, reacting one or tow of alcoholic —OH group of the polyethylene glycol with various organic compounds utilizing a usual method. In this case, the polyethylene glycol derivatives obtained contain various bonding modes, typically ether bonds, ester bonds or other bonds with a sulfur atom or a nitrogen atom, urethane bonds, etc. depending upon the kinds of the organic compounds to be used.

Adequate derivatization should be done based rather on molecular design with respect to molecular weight, miscibility with the other binder and number of polar groups so as to achieve optimization for prevention of bleed-out, cohesive force and viscosity. In the present invention, specific examples of the polyethylene glycol derivatives may include those having ether bonds and those having ester bonds.

When the polyoxyethylene type compound is a polyethylene glycol, the polyethylene glycol can be used a usual one. As the above polyoxyethylene type compounds, those having a molecular weight in the range of 200 to 20,000 are preferred, and in the case of having a plural number of polyoxyethylene chains in the molecule, those having the total molecular weight in the range of 200 to 20,000 are preferred.

Next, specific examples of the polyoxyethylene type compounds to be used in the present invention will be mentioned in more detail.

(1) Polyethylene glycol

Polyethylene glycol and diethylene glycol having an average molecular weight at the recurring unit represented by:

$$\text{-}(CH_2CH_2O)_n\text{-}$$

is in the range of 100 to 20,000 (more specifically, 20,000, 12,000, 9,000, 1,000, 400 and 100) may be mentioned.

(2) Mono- or diester derivatives of polyethylene glycol

When it is particularly derived from polyethylene glycol and a fatty acid, as the fatty acid to be used, those having a carbon atoms in the range of 10 to 50 are preferred. particularly preferred fatty acids are those in the range of 10 to 19 carbon atoms.

Specific examples of the fatty acids may include caprylic acid, undecanoic acid, lauric acid, tridecanoic acid, myristic acid, pentadecanoic acid, palmitic acid, margaric acid, stearic acid, nonadecanoic acid, arachic acid, heneicosanoic acid, behenic acid, tricosanoic acid, lignoceric acid and the like. Of these acids, preferred are nonadecanoic acid, arachic acid, heneicosanoic acid, behenic acid, tricosanoic acid and lignoceric acid. Of course, monoester derivatives or diester derivatives derived from other organic acid than the above may be available, and in the case of the diester derivatives, the organic acid residue to be bonded may be the same or different from each other.

The above mono- or diester derivatives of the polyethylene glycol show only preferred ones, and in the present invention, polyoxyethylene type compounds derived by using a straight monoene acid, a di-, tri- or tetraene acid, a synthetic fatty acid, a tertiary fattyl acid, a branched fatty acid, a dimer acid, a dibasic acid, a polybasic acid, oxycarboxylic acids, a fatty acid chloride, a fatty acid anhydride, a polycarboxylic acid, and a compound having one or more carboxyl group in the molecule.

More specifically, there may be mentioned
polyethylene glycol monobehenate (PEG 4000)
polyethylene glycol distearete (PEG 6000)
polyethylene glycol monopalmitate (PEG 600)
polyethylene glycol dibehenate (PEG 14000)
polyethylene glycol laurynate (PEG 100) and the like.

The numerical value mentioned in the paranthesis at the bottom of the above compound shows an example of the avarage molecular weight of the $-(CH_2CH_2O)_n-$ portion (PEG portion) (same in the following).

(3) Ether derivatives of monoalkyl or arylalkyl ether of polyoxyethylene ether (compoundof polyethylene glycol with one —OH group being etherified)

Ethers to be used are preferably those having 6 or more carbon atoms and particularly preferred are polyoxyethylene ether of alkyl or alkylaryl having 18 to 50 carbon atoms.

The alkyl group of these may be straight or branched and a hydrogen atom of the alkyl group may be substituted with a halogen atom.

Furthermore, polyoxyethylene ethers of an unsaturated hydrocarbon, a synthetic alcohol, an oxycarboxylic acid or a nitrogen-containing sulfur compound may be used.

More specifically, there may be mentioned
polyethylene glycol.mono-p-nonylphenyl ether (PEG 900)
polyethylene glycol monobehenyl ether (PEG 6000)
polyethylene glycol monocetyl ether (PEG 200)
polyethylene glycol monooleyl ether (PEG 4000) and the like.

(4) Ether or ester derivatives of the monoether derivatives shown in the above (3)

That is, they are the above monoalkyl or aryl and/or alkylaryl ether derivatives of polyoxyethylene ether of the above (3) of which residual —OH group is further derivatized into ether derivatives or ester derivatives.

In this case, ester derivatives may be obtained similarly as in the case of the above (2) and ether derivatives as in the case of the above (3).

More specifically, there may be mentioned
monobehenate of polyethylene glycol.mono-p-nonylphenyl ether (PEG 800)
monostearate of polyethylene glycol monostearyl ether (PEG 9000)
polyethylene glycol dibehenyl ether (PEG 6000)
polyethylene glycol monooleyl ether monobehenyl ether (PEG 4000) and the like.

(5) Polyoxyethylene ether derivatives of polyhydric alcohols

That is, they are the polyoxyethylene derivatives of the ester derivatives and/or ether derivatives derivatized either one or more of alcohoric —OH groups of the compound having 2 or more of the alcohoric —OH groups in the molecule [for example, glycerin, polyglycerin, pentaerythritol, sorbitan (1,5-sorbitan, 1,4- or 3,6-sorbitan, isosorbide), mannitol, polyvinyl alcohol having a molecular weight of 800 or less (Poval, trade name) and the like.] similarly as in the above (2) and/or the above (3).

The polyoxyethylene ether derivatives have a single or plural number of polyoxyethylene chains in the molecule. In the present invention, those in which one end of the polyoxyethylene chains is derivatized to the ester derivatives and/or ether derivatives similarly as in the above (2) and/or the above (3) are preferred.

Also, they may have a structure having two or more couples of combined polyhydric alcohols or a structure of crosslinked with polyoxyethylene chains.

More specifically, there may be mentioned
polyethylene monostearate of glycerin
di(polyoxyethylene monostearate) of glycerin
polyoxyethylene monobehenyl ether of sorbitan monobehenate
polyethylene oleate of butyl alcohol
block copolymer of polypropylene glycol and polyoxyethylene glycol
polyoxyethylene ether of polystearate of polyglycerin
polyoxyethylene ether behenate of pentaerythritol distearyl ether
polyoxyethylene ether of sorbitan ester
polyoxyethylene ether of pentaerythritol
ester of polyoxyethylene ether of batyl alcohol ester
polyoxyethylene ether of mannitol ester and the like.

(6) Polyoxyethylene derivatives of molecules having sulfur atom or nitrogen atom Specific examples may include alkylthiopolyoxyethylene ether, polyoxyethylene fatty acid amide, polyoxyethylene alkylamine and the like.

(7) Polyoxyethylene derivatives of polymers or copolymers

Specific examples may include alkylaryl formaldehyde condensed polyoxyethylene ethers, polyoxyethylene ether ester of copolymers, polyoxyethylene ether derivatives of α-olefin maleic anhydride copolymers and the like.

(8) Block polymers of synthetic polymers such as polyesters or polyurethanes with polyoxyethylene (9) Compounds having anionic property Specific examples may include anionic surfactants containing polyoxyethylene such as polyoxyethylene alkyl (aryl) ether carboxylates, polyoxyethylene fatty acid ester sulfates, polyoxyethylene alkyl (aryl) ether phosphates, polyoxyethylene alkyl (aryl) amide phosphoates, polyoxyethylene fatty acid ester carboxylates and the like.

(10) Compounds having cationic property

Specific examples may include cationic surfactants and nonionic surfactants containing polyoxyethylene such as alkyl (aryl) polyoxyethylene ether ammonium salts, polyoxyethylene hydroxyammonium salts and the like.

Among the above polyoxyethylene type compounds of (1) to (10), preferred are the mono- or diester derivatives of polyethylene glycol of the above (2) and the ether derivatives of monoalkyl or arylalkyl ether of polyoxyethylene ether of the above (3). Among them, polyoxyethylene monobehenyl ether and polyoxyethylene distearyl ester are particularly preferred.

The content of the above polyoxyethylene type compound in the thermal transfer colorant layer is preferably in the range of 1 to 50% by weight based on the components constituting the layer, and particularly preferred is in the range of 4 to 30% by weight.

Further, the modified silicone compound and the polyoxyethylene type compound are generally used with the weight ratio in the range of 50:50 to 99:1. Particularly, the weight ratio in the range of 60:40 to 99:1 is preferably used.

If the amount of the polyoxyethylene type compound is in excess of the above range, printing quality may sometimes be lowered.

(Heat-fusible substance)

The heat-fusible substance which can be used in the thermal transfer recording medium of the present invention is a solid state or a semisolid state substance having a melting point of generally in the range of 40° to 150° C. (preferably in the range of 50° to 100° C.) measured by using the Yanagimoto MJP-2 type (trade name) apparatus.

As the specific examples of the heat-fusible substance, there may be mentioned, for example, waxes including vegitable waxes such as carnauba wax, wood wax, auricuri wax, espal wax, etc; animal waxes such as beedwax, insect wax, shellac wax, whale wax, etc.; petroleum waxes such as paraffin wax, microcrystalline wax, polyethylene wax, polyester wax, acid wax, etc.; and mineral waxes such as montan wax, ozokerite, ceresin, etc.; higher fatty acids such as palmitic acid, stearic acid, margaric acid, behenic acid, etc.; higher alcohols such as palmityl alcohol, stearyl alcohol, behenyl alcohol, marganyl alcohol, myrisyl alcohol, eicosanol, etc.; higher fatty acid esters such as cetyl palmitate, myrisyl palmitate, cetyl stearate, myrisyl stearate, etc.; amides such as acetamide, propionic amide, palmitic amide, stearic amide, amide wax, etc.; higher amines such as stearyl amine, behenyl amine, palmityl amine, etc.; and silicone compounds having a melting point of 30° C. or higher and modified silicone compounds, and they may be used singly or in combination.

In the present invention, among the above heat-fusible substances, the heat-fusible substance having a melting point in the range of 50° to 100° C. measured by the above method is preferably used. Further, it is particularly preferred that among paraffin wax, carnauba wax, polyethylene wax and microcrystalline wax, by selecting those having a melting point in the range of 50° to 80° C., and they are used singly or in combination of two or more kinds.

The content of the heat-fusible substance in the thermal transfer colorant layer is generally set in the range of 20 to 80% by weight based on the total weight of the component constituting said layer. If the content is less than 20% by weight, printing quality may sometimes be lowered.

(Thermoplastic resin)

As the thermoplastic resin to be formed the thermal transfer colorant layer of the present invention, there may be usually used thermoplastic resins including, for example, resins such as polyurethane resins, polyester type resins, polyamide type resins, polyester type resins, polyolefin resins, acryl type resins, vinyl chloride type resins, cellulose type resins, rosin type resins, petroleum type resins, ionomers, etc.; elastomers such as natural rubbers, styrene-butadiene rubber, isoprene rubber, chloroprene rubber, etc.; rosin derivatives such as ester gum, rosin-maleic acid resins, rosin-phenol resins, hydrated rosins, etc.; high molecular weight compounds having a softening point of 50° to 150° C. such as phenol resins, terpene resins, cyclopentadiene resins, aromatic resins, etc. Particularly preferable thermoplastic resins are copolymers obtained from at least ethylene and a monomer represented by the following formula:

$$CH_2{=}\underset{\underset{COOR^2}{|}}{CR^1}$$

wherein in the above formula, $R^1$ represents a hydrogen atom or a methyl group; $R^2$ represents a straight or branched alkyl group having 1 to 8 carbon atoms.

As the alkyl group for $R^2$, there may be mentioned, for example, a methyl group, en ethyl group, an n-propyl group, an isopropyl group, a butyl group, an isobutyl group, a t-butyl group, a pentyl group, a hexyl group, a heptyl group and an octyl group.

Further, the copolymer to be used in the present invention may be a copolymer containing, in addition to the above monomer, at least one of a dibasic acid, its alkali metal salt (e.g., sodium salt, potassium salt) and an anhydride of the dibasic acid as a recurring unit (hereinafter sometimes merely referred to "dibasic acid type recurring unit"). As examples of other monomer unit contained in the copolymer, there may be mentioned maleic acid, maleic anhydride, sodium maleate and potassium maleate, fumalic acid, sodium fumalate and potassium fumalate, and itaconic acid, itaconic anhydride, sodium itaconate and potassium itaconate.

Molar ratio of the ethylene and the monomer represented by the above formula in the above copolymer is usually set in the range of 50:50 to 90:10 (preferably in the range of 62:38 to 79:21). Also, when the dibasic acid type recurring unit is contained, the molar ratio of the ethylene and the dibasic acid type recurring unit is set within the range of 85:15 to 99.5:0.5 (preferably 90:10 to 99.5:0.5). If it is out of the above range, transfer property may sometimes be lowered.

As such a copolymer, there may be specifically mentioned, for example, ethylene-acrylate copolymers and their maleic anhydride-modified products such as ethylene-methyl acrylate copolymer, ethylene-ethyl acrylate copolymer, ethylene-propyl acrylate copolymer, ethylene-n-butyl acrylate copolymer, ethylene-isobutyl acrylate copolymer, ethylene-pentyl acrylate copolymer, ethylene-hexyl acrylate copolymer, ethylene-octyl acrylate copolymer and the like; ethylene-methacrylate copolymers and their maleic anhydride-modified products such as ethylene-methyl methacrylate copolymer, ethylene-ethyl methacrylate copolymer, ethylene-propyl methacrylate copolymer, ethylene-n-butyl methacrylate copolymer, ethylene-isobutyl methacrylate copolymer, ethylene-pentyl methacrylate copolymer, ethylene-hexyl methacrylate copolymer, ethylene-octyl methacrylate copolymer and the like; terpolymer of ethylene-acrylate-maleic anhydride such as ethylene-methyl acrylate-maleic anhydride copolymer, ethylene-ethyl acrylate-maleic anhydride copolymer, ethylene-propyl acrylate-maleic anhydride copolymer, ethylene-n-butyl acrylate-maleic anhydride copolymer, ethylene-isobutyl acrylate-maleic anhydride copolymer, ethylene-pentyl acrylate-maleic anhydride copolymer, ethylene-hexyl acrylate-maleic anhydride copolymer, ethylene-octyl acrylate-maleic anhydride copolymer and the like; and terpolymer of ethylenemethacrylate-maleic anhydride such as ethylene-methyl methacrylate-maleic anhydride copolymer, ethylene-ethyl methacrylate-maleic anhydride copolymer, ethylene-propyl methacrylate-maleic anhydride copolymer, ethylene-n-butyl methacrylate-maleic anhydride copolymer, ethylene-isobutyl methacrylate-maleic anhydride copolymer, ethylene-pentyl methacrylate-maleic anhydride copolymer, ethylene-hexyl methacrylate-maleic anhydride copolymer, ethylene-octyl methacrylate-maleic anhydride copolymer and the like.

Further, copolymers in which a part of maleic anhydride in the above copolymers are hydrolyzed to become maleic acid monomers (including an alkali metal salt of maleic acid), and copolymers obtained by copolymerization of ethylene, alkyl acrylate and/or alkyl methacrylate each having alkyl group with 1 to 8 carbon atoms and maleic acid can be also included within the copolymers of the present invention.

Further, the copolymers may be contained other recurring units within the range not impairing the characteristics.

In the present invention, among the above copolymers, it is preferred to use by selecting a kind or two or more of thermoplastic resins from ethylene-ethyl acrylate copolymer, ethylene-ethyl acrylate-maleic anhydride copolymer, hydrogenated rosin, petroleum resin and hydrogenated terpene resin. By using the above as the thermoplastic resin, printing quality is improved. In addition, since compatibility of the copolymer with the modified silicone compound and polyoxyethylene type compound to be used in the present invention is particularly good, running property is tend to be increased and also printing quality is tend to be further improved.

The preparative method of these copolymers to be used in the present invention has already been known and in the present invention, those which has been prepared by the known method can be used.

In the thermal transfer colorant layer of the thermal transfer recording medium of the present invention, the above copolymers may be used alone or may be used in combination with the aforesaid conventionally used thermoplastic resin.

Content of the thermoplastic resin in the thermal transfer colorant layer is usually set as 50% by weight or less based on the total weight of the components constituting said layer.

When the thermal transfer colorant layer contains the thermoplastic resin and the heat-fusible subtance, the formulating weight ratio of the thermoplastic resin and the heat-fusible subtance in the layer is usually set within the range of 10:90 to 99:1 (preferably 60:40 to 95:5).

(Colorant)

The thermal transfer colorant layer usually comprises dispersing a colorant in the above heat-fusible subtance and/or the thermoplastic resin.

As the colorant, carbon black is usually employed, but when the medium is used for color transfer, known organic pigments, organic dyes and inorganic dyes can be used. When it is used for color transfer, in general, yellow colorants [e.g., Hanza Yellow A (trade name), insoluble azo type red pigments (Fast Yellow G (trade name), etc.), dye Lake type yellow pigments (Yellow Lake, etc.)]; red colorants [e.g., Rohdamine Lake B (trade name), insoluble azo type red pigments (Brillicant Carmel BS (trade name), etc.), soluble Azo type red pigments (Lake Orange (trade name), etc.)]; and blue colorants [e.g., phthalocyanine type blue pigments (phthalocyanine blue, etc.), dye Lake type blue pigments (blue Lake, etc.), building dye type blue pigment (Fast Blue Lake, etc.)] are provided in block state.

Content of the colorant in the layer is usually within the range of 5 to 30% by weight based on the total weight of the above thermoplastic resin and the heat-fusible subtance which act as binders.

(Others)

In the present invention, by using the aforesaid silicone compound, sufficient lubricity has been endowed to the thermal transfer recording medium and the running property and printing quality thereof are both excellent. Therefore, any other oily components are not necessarily added thereto, but mineral oils, animal and vegitable oils, and surfactants may be added.

Further, the thermal transfer colorant layer may further contain other components which are usually contained in a conventional thermal transfer colorant layer.

The thermal transfer recording medium of the present invention may be provided the thermal transfer colorant layer directly on the above support, but the thermal transfer colorant layer may be provided through a peeling layer.

The peeling layer usually comprises containing the above heat-fusible substance and the thermoplastic resin and the formulating ratio shall be so set as to become the property of the heat-fusible substance supremely.

A film thickness of the peeling layer is usually within the range of 0.5 to 5 $\mu$m in consideration with adhesiveness and peeling property between the thermal transfer colorant layer and the support.

Also, in the thermal transfer recording medium of the present invention, the above thermal transfer colorant layer may constitute the uppermost layer, but an overcoat layer may be provided on the thermal transfer colorant layer.

The overcoat layer usually comprises the above heat-fusible substance and the thermoplastic resin as main components, and the contents of both components shall be set so as to become the characteristics of the thermoplastic resin supremely. A film thickness of the overcoat layer is usually 2 $\mu$m or less.

The thermal transfer recording medium of the present invention can be prepared by the conventional method.

That is, a coating solution of the components for forming the thermal transfer colorant layer is coated by the known method such as the method in which a wire bar is used on the support, the gravure coater method, the squeeze coater method, As the coating solution of the components for forming the thermal transfer colorant layer, those prepared by dissolving or dispersing in a solvent (e.g., toluene, xylene, etc.) may be used. Further, by preparing an aqueous emulsion of the forming components, it can be provided according to the aqueous coating method. In this case, the aqueous emulsion to be used may be prepared by adding a surfactant to the components for forming the thermal transfer colorant layer to disperse them therein utilizing a known method.

Whent the thermal transfer recording medium of the present invention has a peeling layer, the peeling layer is usually provided by the hot melt method.

Also, when the thermal transfer recording medium of the present invention has an overcoat layer, the overcoat layer can be provided by any of the hot melt method, the method using an organic solvent and the aqueous coating method using an aqueous emulsion.

After each layer was provided as mentioned above, passing through the surface smoothing processing steps, etc., if necessary, it shall be cut to a desired shape to form the thermal transfer recording medium of the present invention.

As to the shape of the thermal transfer recording medium of the present invention thus obtained, there is not particularly limited but in generall it is used in the form of a ribbon for a typewriter or a broad width tape which is employed for a line printer, etc.

The thermal transfer method using the thermal transfer recording medium is not different from the usual thermal transfer recording system, but by way of precaution, in the case of using a thermal head which is the most typical as the heat source will be explained.

That is, the thermal transfer colorant layer (when an overcoat layer is provided, it is the overcoat layer) of the thermal transfer recording medium is contacted to a medium to be transferred (for example, a transfer paper), while applying a thermal pulse by a platen from the back surface of the transfer paper, if necessary, and the thermal transfer colorant layer is sectionally heated in accordance with a desired printing or transferring pattern. The portion to be heated of the thermal transfer colorant layer is increased in temperature and the thermal transfer colorant layer rapidly soften, then the softened thermal transfer colorant layer is transferred to the medium to be transferred.

In the thermal transfer recording medium, since the thermal transfer colorant layer contains the modified silicone compound and the polyoxyethylene type compound, it is little that a surface of the thermal transfer colorant layer and a back surface of the support do not adhere with each other, for example, at wound state. Accordingly, it is needless to say when it is used for a large scale apparatus, even when it is used for a small size apparatus such as a portable word processor, the thermal transfer recording medium can be run smoothly. That is, it is less in lowering of transferring performance due to running property of the thermal transfer recording medium. Further, printing quality to a so-called rough paper which is low in surface smoothness is improved.

Also, generation of bleed-out which sometimes occurs when the polyoxyethylene type compound is employed can be effectively prevented.

Further, the modified silicone compound has a function of adjusting an adhesion property between the support and the thermal transfer colorant layer. Therefore, at the time of transfer with use of thermal transfer recording medium of the present invention, the thermal transfer colorant layer is easily peeled off from the support whereby unpleasant peeling sound is less caused.

Moreover, in the thermal transfer recording medium, since compatibility of the modified silicone resin is excellent, it is not provided on the surface of the thermal transfer recording medium excessively even it has an excellent running property as mentioned above, and thus transfer which causes less stain at the ground portion can be carried out.

EXAMPLES

In the following, Examples of the present invention will be mentioned but the present invention is not limited by these at all. In the following description, all "parts" means "parts by weight".

EXAMPLE 1

A component of a coating solution composition I for a thermal transfer colorant layer shown below was pulverized by using a sand grinder while heating at 90° C., and then a solvent was added thereto to prepare a coating solution for a thermal transfer colorant layer.

The resulting coating solution for a thermal transfer colorant layer was applied on a polyethylene terephthalate film having a thickness of 3.5 μm by using a wire bar to a dried film thickness of 4.0 μm to prepare a thermal transfer recording medium.

Thermal transfer colorant layer cotaing solution composition I

Alcohol-modified silicone compound (X-22-80lb (trade name), available from Shin-etsu Kagaku Kogyo Co., Ltd.): 9 parts
Polyoxyethylene behenyl ester (POE chain: 5): 4 parts
Paraffin wax (melting point: 69° C.): 15 parts
Carnauba wax: 25 parts
Tackifier (Arcone P100 (trade name), available from Arakawa Kagaku K.K.): 10 parts
Ethylene-ethyl acrylate copolymer (NUC-6179 (trade name), available from Nippon Unicar K.K.): 10 parts
Carbon black: 10 parts

COMPARATIVE EXAMPLE 1

A thermal transfer recording medium was prepared in the same manner as in Example 1 except for using polyoxyethylene behenyl ester.

COMPARATIVE EXAMPLE 2

A thermal transfer recording medium was prepared in the same manner as in Example 1 except for using alcohol-modified silicone compound.

COMPARATIVE EXAMPLE 3

A thermal transfer recording medium was prepared in the same manner as in Example 1 except for using polyoxyethylene behenyl ester and alcohol-modified silicone compound.

EXAMPLE 2

A thermal transfer recording medium was prepared in the same manner as in Example 1 except for using a thermal transfer colorant layer coating solution composition II as mentioned below in place of the thermal transfer colorant layer coating solution composition I.

Thermal transfer colorant layer cotaing solution composition II

Polyether-modified silicone compound (KF-945 (trade name), available from Shin-etsu Kagaku Kogyo Co., Ltd.): 15 parts
Polyoxyethylene monostearate (POE chain: 40): 4 parts
Paraffin wax (melting point: 69° C.): 15 parts
Ester wax: 25 parts
Terpene resin (YS resin Px (trande name), available from Yasuhara Yushi K.K.): 6 parts
Ethylene-ethyl acrylate-maleic anhydride copolymer (BONDIN HX-8140 (trade name), available from Sumitomo C.D.F. K.K.): 10 parts
Carbon black: 15 parts

COMPARATIVE EXAMPLE 4

A thermal transfer recording medium was prepared in the same manner as in Example 2 except for using polyoxyethylene monostearate.

COMPARATIVE EXAMPLE 5

A thermal transfer recording medium was prepared in the same manner as in Example 2 except for using polyether-modified silicone compound.

COMPARATIVE EXAMPLE 6

A thermal transfer recording medium was prepared in the same manner as in Example 1 except for using polyoxyethylene monostearate and polyether-modified silicone compound.

EXAMPLE 3

A thermal transfer recording medium was prepared in the same manner as in Example 1 except for using a thermal transfer colorant layer coating solution composition III as mentioned below in place of the thermal transfer colorant layer coating solution composition I.

Thermal transfer colorant layer cotaing solution composition III

Higher fatty acid-modified silicone compound (KF-910 (trade name), available from Shin-etsu Kagaku Kogyo Co., Ltd.): 5 parts
Polyoxyethylene distearate (POE chain: 140): 8 parts
Paraffin wax (melting point: 69° C.): 45 parts
Polyethylene wax: 5 parts
Carnauba wax: 12 parts
Ethylene-ethyl acrylate-maleic anhydride copolymer (NUC-ACE GB-201, available from Nippon Unicar K.K.): 12.5 parts
Hydrogenated rosin: 7.5 parts
Carbon black: 15 parts

COMPARATIVE EXAMPLE 7

A thermal transfer recording medium was prepared in the same manner as in Example 3 except for using polyoxyethylene distearate.

COMPARATIVE EXAMPLE 8

A thermal transfer recording medium was prepared in the same manner as in Example 3 except for using higher fatty acid-modified silicone compound.

COMPARATIVE EXAMPLE 9

A thermal transfer recording medium was prepared in the same manner as in Example 3 except for using polyoxyethylene distearate and higher fatty acid-modified silicone compound.

EXAMPLE 4

A thermal transfer recording medium was prepared in the same manner as in Example 1 except for using a thermal transfer colorant layer coating solution composition IV as mentioned below in place of the thermal transfer colorant layer coating solution composition I.

Thermal transfer colorant layer cotaing solution composition IV

Alcohol-modified silicone compound (KF-851 (trade name), available from Shin-etsu Kagaku Kogyo Co., Ltd.): 5 parts
Polyoxyethylene distearate (POE chain: 140): 8 parts
Paraffin wax (melting point: 69° C.): 52 parts
Carnauba wax: 20 parts
Petroleum resin: 4 parts
Carbon black: 11 parts

EXAMPLE 5

A thermal transfer recording medium was prepared in the same manner as in Example 1 except for using a thermal transfer colorant layer coating solution composition V as mentioned below in place of the thermal transfer colorant layer coating solution composition I.

Thermal transfer colorant layer cotaing solution composition V

Polyether-modified silicone compound (KF-945 (trade name), available from Shin-etsu Kagaku Kogyo Co., Ltd.): 2 parts
Polyoxyethylene distearate (POE chain: 140): 8 parts
Paraffin wax (melting point: 63° C.): 42 parts
Polyethylene wax (AL61 (trade name), available from BASF Co., Ltd.): 20 parts
Ethylene-ethyl acrylate-maleic anhydride copolymer (BONDIN HX-8140 (trade name), available from Sumitomo C.D.F. K.K.): 10 parts
Petroleum resin (Alcon P-1100 (trade name), available from Arakawa Kagaku K.K.): 8 parts
Carbon black: 11 parts

Evaluation

The thermal transfer recording media obtained were cut and contained in a cassette, and torques required for running were measured by using a torque gauge with respect to each medium.

The thermal transfer recording media obtained were recorded (printed) on a spica bond paper having a smoothness of 10 second with a printing rate of 20 cps by using a thermal printer of a portable word processor, and printed portions were observed by using a magnifying glass and printing quality was evaluated according to the following standard.

The results are shown in Table 1.

In Table 1, measured results of winding torques are as shown below.

O: not more than 5 kgfcm of torque
Δ: within 5 to 15 kgfcm of torque
X: not less than 15 kgfcm of torque Further, as to the evaluation of printing quality, the evaluation means as shown below.

O: clear alphabet can be reproduced.
Δ: reproduction of alphabet is somewhat blurred.
X: reproduction of alphabet is blurred.

TABLE 1

| | Running property | Printing quality |
|---|---|---|
| Example 1 | | |

TABLE 1-continued

| | Running property | Printing quality |
|---|---|---|
| Comparative example 1 | | X |
| Comparative example 2 | X | Δ |
| Comparative example 3 | | X |
| Example 2 | | |
| Comparative example 4 | | X |
| Comparative example 5 | X | Δ |
| Comparative example 6 | | X |
| Example 3 | | |
| Comparative example 7 | | X |
| Comparative example 8 | X | Δ |
| Comparative example 9 | | X |
| Example 4 | | |
| Example 5 | | |

As clearly seen from Table 1, it can be understood that the thermal transfer recording media of the present invention have low in running torque whereby they show good running property as well as printing quality to a rough paper has also improved by adding the polyoxyethylene type compound and the modified silicone compound. Accordingly, it can be used well even in a portable word processor which is small in a running driving force of the thermal transfer recording medium and a rough paper is often used.

Further, the thermal transfer recording media of the present is less in occurrence of noise due to peeling at transfer and also less in occurrence of ground stain due to bleed-out of the modified silicone compound.

EXAMPLE 6

A thermal transfer recording medium was prepared in the same manner as in Example 1 except for using a thermal transfer colorant layer coating solution composition VI as mentioned below in place of the thermal transfer colorant layer coating solution composition I.

Thermal transfer colorant layer cotaing solution composition VI

Alcohol-modified silicone compound (X-22-80lb (trade name), available from Shin-etsu Kagaku Kogyo Co., Ltd.): 10 parts
Polyoxyethylene distearate (POE chain: 2): 5 parts
Paraffin wax (melting point: 69° C.): 20 parts
Microcrystalline wax: 30 parts
Ethylene-ethyl acrylate copolymer (NUC-6570 (trade name), available from Nippon Unicar K.K.): 8 parts
Hydrogenated terpene resin: 15 parts
Carbon black: 10 parts

COMPARATIVE EXAMPLE 10

A thermal transfer recording medium was prepared in the same manner as in Example 4 except for using polyoxyethylene distearate.

By using the thermal transfer recording media prepared in the above Example 6 and Comparative example 10, thermal transfer was carried out in the same manner as in Example 1, and as results, while in Comparative example 10, bleed-out due to the polyoxyethylene type compound can be observed, in Example 6, no bleed-out was observed.

We claim:

1. A thermal transfer recording medium having a thermal transfer colorant layer provided on a support, and wherein said thermal transfer colorant layer contains a colorant, a polyoxyethylene type compound having a moiety represented by the following formula in the molecule:

$$-(CH_2CH_2O)_n-$$

wherein n is an integer of at least 2; and at least one modified silicon compound selected from the group consisting of an alkyl-modified silicon compound, a polyether-modified silicone compound, an amino-modified silicon compound, an alcohol modified silicone compound, a mercapto-modified silicone compound, a carboxyl-modified silicone compound and an epoxy-modified silicone compound.

2. The thermal transfer recording medium according to claim 1, wherein the content of said modified silicone compound is 0.01% by weight or more based on components constituting the thermal transfer colorant layer.

3. The thermal transfer recording medium according to claim 1, wherein said modified silicone compound is solid or semisolid.

4. The thermal transfer recording medium according to claim 3, wherein the content of said modified silicone compound is in the range of 0.1 to 50% by weight based on components constituting the thermal transfer colorant layer.

5. The thermal transfer recording medium according to claim 4, wherein the content of said modified silicone compound is in the range of 1 to 20% by weight based on components constituting the thermal transfer colorant layer.

6. The thermal transfer recording medium according to claim 1, wherein said modified silicone compound is liquid.

7. The thermal transfer recording medium according to claim 6, wherein the content of said modified silicone compound is in the range of 0.1 to 8% by weight based on components constituting the thermal transfer colorant layer.

8. The thermal transfer recording medium according to claim 7, wherein the content of said modified silicone compound is in the range of 0.1 to 5% by weight based on components constituting the thermal transfer colorant layer.

9. The thermal transfer recording medium according to claim 1, wherein the content of said polyoxyethylene type compound is in the range of 1 to 50% by weight based on components constituting the thermal transfer colorant layer.

10. The thermal transfer recording medium according to claim 9, wherein the content of said polyoxyethylene type compound is in the range of 4 to 30% by weight based on components constituting the thermal transfer colorant layer.

11. The thermal transfer recording medium according to claim 1, wherein the weight ratio of said modified silicone compound and said polyoxyethylene type compound is in the range of 50:50 to 99:1.

12. The thermal transfer recording medium according to claim 11, wherein the weight ratio of said modified silicone compound and said polyoxyethylene type compound is in the range of 60:40 to 99:1.

13. The thermal transfer recording medium according to claim 1, wherein said polyoxyethylene type compound is at least one selected from the group consisting of polyoxyethylene monobehenyl ether, polyoxyethylene distearyl ester, polyoxyethylene behenyl ester, polyoxyethylene monostearate and polyoxyethylene distearate.

14. The thermal transfer recording medium according to claim 1, wherein the melting point of the polyoxyethylene type compound is 30° to 120° C.

15. The thermal transfer recording medium according to claim 14, wherein the melting point of the polyoxyethylene type compound is 40° to 100° C.

* * * * *